US005548939A

United States Patent [19]

Carmical

[11] Patent Number: 5,548,939

[45] Date of Patent: Aug. 27, 1996

[54] ADJUSTABLE INSERT FOR USE WITH CONCRETE OR STEEL

[76] Inventor: Clifton Carmical, 3402 W. Justice, Cabot, Ark. 72023

[21] Appl. No.: 248,958

[22] Filed: May 25, 1994

[51] Int. Cl.[6] ..... E04B 1/41

[52] U.S. Cl. ..... 52/707; 52/698; 52/704; 52/708

[58] Field of Search ..... 52/698, 699, 701, 52/704, 707, 708, 710, 383, 702

[56] References Cited

U.S. PATENT DOCUMENTS

| | | | |
|---|---|---|---|
| 1,172,664 | 2/1916 | Banes . | |
| 1,201,540 | 10/1916 | Banes | 52/708 |
| 1,212,990 | 1/1917 | Newhall et al. | 52/708 |
| 1,244,992 | 10/1917 | Lee | 52/698 |
| 1,285,202 | 11/1918 | Jaques et al | 52/699 |
| 1,351,119 | 8/1920 | Ogden | 52/708 X |
| 1,511,542 | 10/1924 | Tomkinson | 52/708 |
| 1,511,764 | 10/1924 | Jordahl . | |
| 1,768,246 | 6/1930 | Gaddis | 52/708 |
| 1,769,498 | 7/1930 | Downing . | |
| 1,841,887 | 1/1932 | Goldsmith et al. | 52/706 X |
| 1,922,479 | 8/1933 | Joslin | 52/711 X |
| 2,133,134 | 10/1938 | Davis | 52/708 |
| 2,163,446 | 6/1939 | Heckman | 52/708 X |
| 3,327,438 | 6/1967 | Cooper | 52/205 |
| 3,620,277 | 11/1971 | Tummarello . | |
| 3,798,865 | 3/1974 | Curtis | 52/715 X |
| 4,000,591 | 1/1977 | Courtois | 52/698 X |
| 4,194,333 | 3/1980 | Paton et al. . | |
| 4,523,413 | 6/1985 | Koppenberg | 52/704 X |
| 4,542,871 | 9/1985 | Fortsch | 248/73 |
| 4,708,554 | 11/1987 | Howard | 52/710 X |
| 4,741,582 | 5/1988 | Peroni . | |
| 4,831,796 | 3/1989 | Ladduwahetty . | |
| 4,905,444 | 3/1990 | Semaan et al. | 52/710 |
| 4,948,313 | 8/1990 | Zankovich . | |
| 5,333,435 | 8/1994 | Leek | 52/704 |

FOREIGN PATENT DOCUMENTS

| | | | |
|---|---|---|---|
| 537066 | 2/1957 | Canada | 52/710 |
| 664178 | 6/1963 | Canada | 52/704 |
| 5-44268 | 2/1993 | Japan | 52/698 |
| 374536 | 6/1932 | United Kingdom | 52/701 |
| 399581 | 10/1933 | United Kingdom | 52/709 |

*Primary Examiner*—Carl D. Friedman
*Assistant Examiner*—Laura A. Saladino

[57] ABSTRACT

An insert for casting in a body of concrete to provide for attachment to a building structure. The insert is formed of a slotted face plate welded to a channel with enclosed ends and an access opening for insertion of an attachment device for attachment to the building structure. The insert is also provided with anchors for anchoring the insert in the concrete body.

8 Claims, 10 Drawing Sheets

ADJUSTABLE INSERT FOR USE WITH CONCRETE OR STEEL

BACKGROUND OF THE INVENTION

This invention relates to connections for concrete members to be joined together with a structure during the process of erection.

Generally, an insert is placed into a body of concrete during the casting of the concrete. It is then held in place until the concrete hardens. This creates a portion of a connection that will serve to hold the concrete member onto an inner structure to form a completed structure.

Typically, the connection is formed by connecting a continuously threaded rod to a slot in the insert; for example, a nut and bolt may be used. This slot is usually parallel to the insert's longitudinal axis. The slot allows a tolerance vertically or horizontally to allow for the face of the member to align with another and to allow for normal expansion and contraction of the structure.

A different type of attachment device uses a piece of flat steel referred to as a strap. It is inserted into the body of the device and welded to the inner structure.

As noted above, the adjustable inserts can allow for expansion and contraction of the concrete. The connection is made so the bolt and nut are not tightened to the maximum amount so that when the concrete expands and contracts the connections can remain intact.

SUMMARY OF THE INVENTION

The present invention has very significant advantages compared to the prior type of insert. It is built of a weldable grade of steel (preferably A-36). It has a single slot with a rectangular enclosure attached and a square hole parallel to the slot as to allow a large variety of attachment means to be inserted within the enclosure. The attachment means can range from an A-325 bolt and nut to an A-307 bolt and nut to a specially built weldable strap.

Another outstanding feature of this insert is that it may use headed concrete anchors, deformed bar anchors or a weldable plate. The headed concrete anchors are very common in concrete construction due to the high pull-out resistance and shear capacity. In comparison any flanged or bolted insert of comparable size can not reach the capacities of the insert presented here with the same cost. Another feature of the present invention is that the ends are closed. Open end inserts must be closed with caps or run the risk of being filled with concrete when the insert is placed in the wet concrete member.

BRIEF DESCRIPTION

DETAILED DESCRIPTION OF THE PREFERRED EMBODIMENTS

Figure 1:
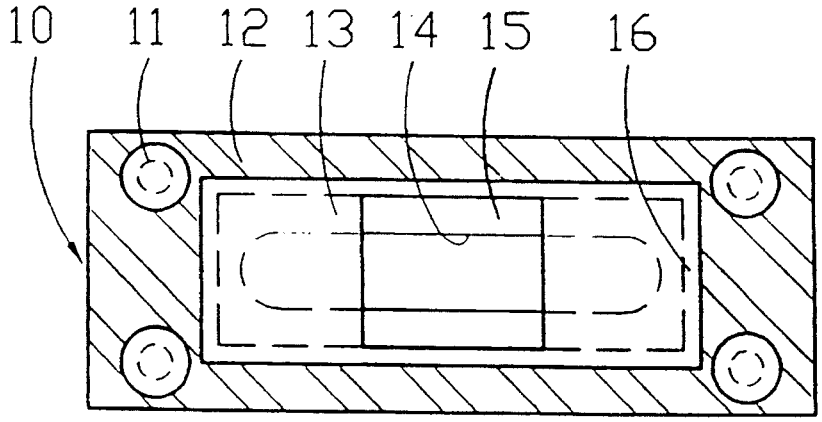
FIG. 1 is a plan view of the insert without attachment means present but with headed concrete anchors for connection to concrete.
Figure 2:
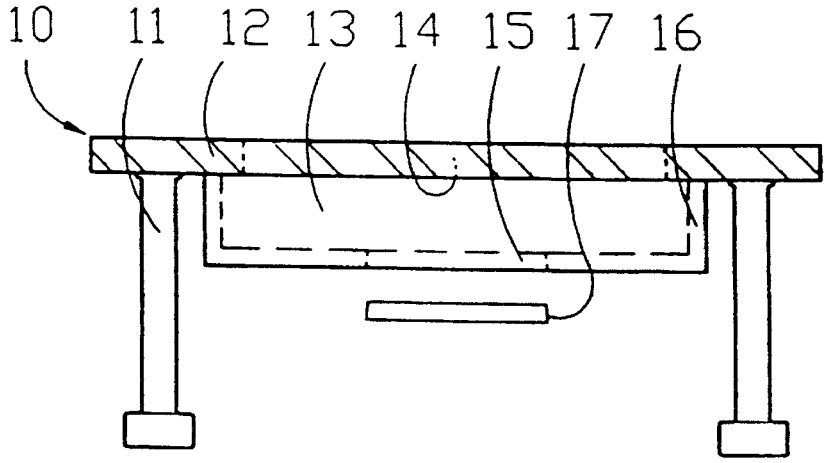
FIG. 2 is an elevation view of the insert in FIG. 1 with an opening for attachment means to be installed.

In FIGS. 1 and 2 the adjustable type concrete insert is generally designated 10. The inserts are formed by first cutting an elongated face plate 12 with a slot 14 cut into the plate 12 along a longitudinal axis of the plate 12. A channel 13 with enclosed ends 16 is attached to the plate 12, as, for example, by welding, thus forming an enclosure. The enclosure is substantially rectangular in shape. The ends 16 of the channel 13 are formed by either cutting away a portion of the channel 13 and bending to enclose the ends 16 or by adding some type of cap over or into the ends 16. A square hole 15 is made in the back side of the channel 13. The hole 15 is of sufficient area to accommodate an attachment means such as a strap, bolt or nut. The hole 15 must be wider than the slot 14 so that the attachment means can be passed through the hole 15 but be restrained from passing completely through the slot 14. For example, in the case of a bolt, the threaded shaft of the bolt could pass through the slot 14 but the head of the bolt could only pass through the hole 15 but not the slot 14.

The square plate 17 that is removed from the channel 13 to form the hole 15 may be reinstalled at a later time. It is reinstalled after attachment means is installed and a finish of galvanizing, zinc plating or paint is performed.

As noted above, a weld will be formed of the appropriate size to stiffen the face plate 12 with the channel 13. After the plate 12 and the channel 13 have been joined by welding, then the headed concrete anchors 11 are installed, also typically by welding.

Figure 3:
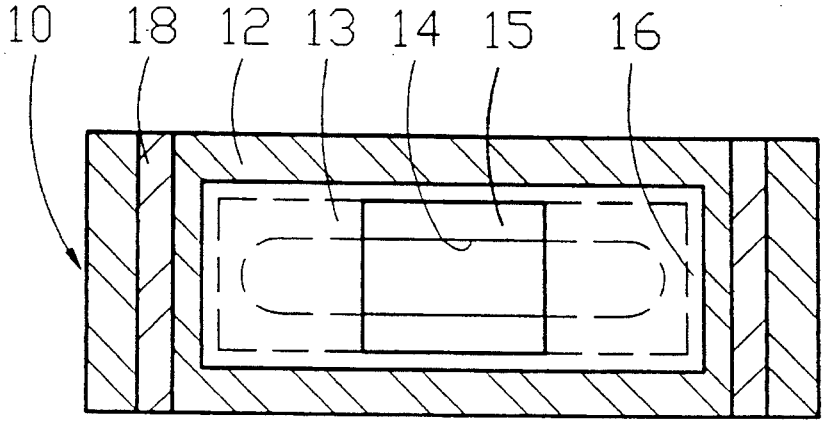
FIG. 3 is a plan view of the insert without attachment means present but with steel plates for connection to steel members rather than concrete members.
Figure 4:
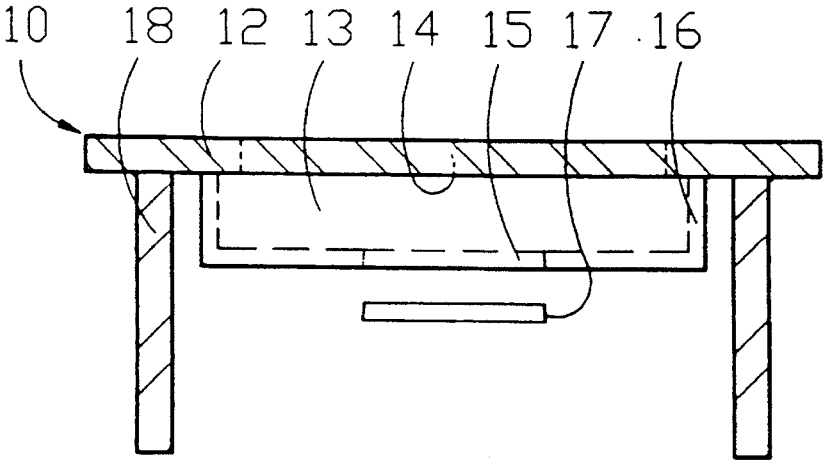
FIG. 4 is an elevation view of the insert in FIG. 3.

FIGS. 3 and 4 illustrates the same basic format for an insert 10. The change in this embodiment is that a flat piece of steel 18 has replaced the headed anchors 11 at the ends so as to be connected with a member other than concrete. The insert 10 is identical with the exception that it now can be used for a connection onto a steel beam or weld plates that are found in an inner structure of a building. This type of 10 insert is differs from those that are common used at the present time and present more strength than a comparable plate that would be welded and slotted.

Figure 5:
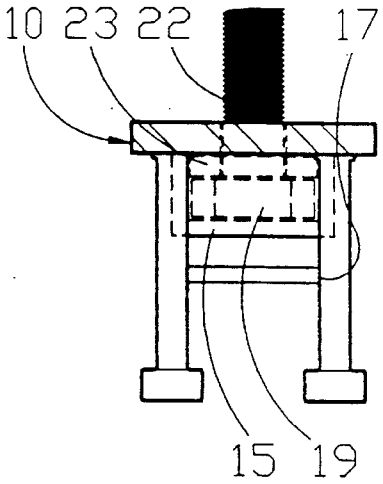
FIG. 5 is an end view of the insert with a bolt and plate washer attachment means.
Figure 10:
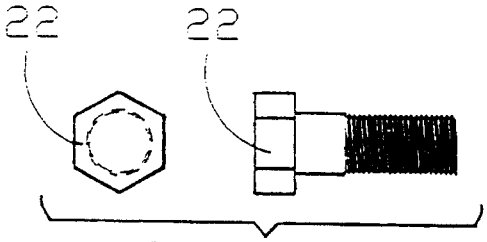
FIG. 10 is a plan and an elevation view of a bolt to be used in the insert.
Figure 14:
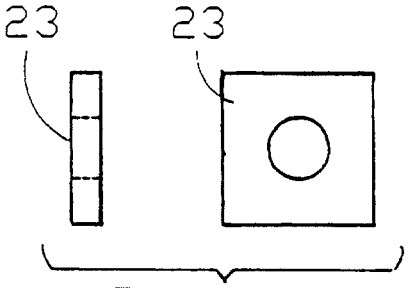
FIG. 14 is a plan and an elevation view of a plate washer adapted to the bolt of FIG. 10.

FIG. 5 illustrates an end view of the insert 10 with a bolt 22 of FIG. 10 and inserted through a plate washer 23 of FIG. 14 with the plate washer 23 to be the appropriate size to fill any excess room in the rectangular channel 13. The plate washer 23 is inserted through opening 15 and bolt 22 is inserted through the hole 15, plate washer 23 and through the slot 14. Plate 17 is reinstalled as to not allow concrete into the enclosure of the channel 13. Prior art inserts are open at the ends and a bolt can not be inserted through the access opening.

The significance of this connection device is that the bolt head 19 is of appropriate size as to turn within the rectangular enclosure of the channel 13 and can serve to connect with another threaded insert. This insert is very effective to minimize welding and to allow great amounts of tolerance with high strength.

Figure 6:
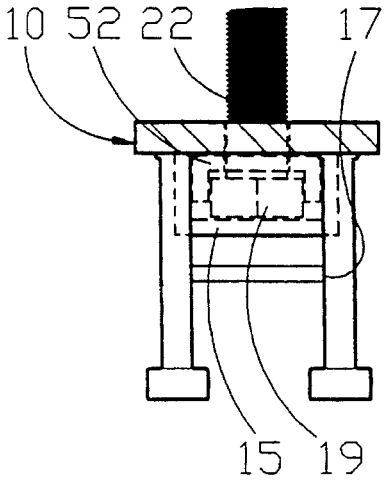
FIG. 6 is an end view of the insert with a bolt and an alternative form of plate washer to prevent the bolt from turning.
Figure 12:
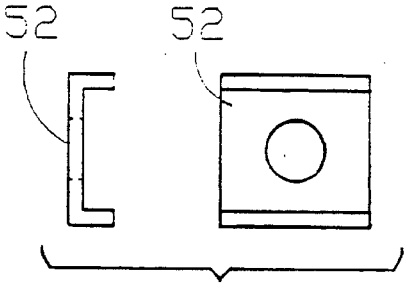
FIG. 12 is a plan and an elevation view of a plate washer adapted to prevent the bolt of FIG. 10 from turning in the insert.

FIG. 6 is an end view of the insert 10 demonstrating a bolt 22 from FIG. 10 installed through a special plate washer 52 of FIG. 12. It is constructed in a manner in which it has flanges that protrude upward to hold the flat portions of the bolt's head 19 and will not allow it to turn during the time the connection is being installed.

Figure 7:
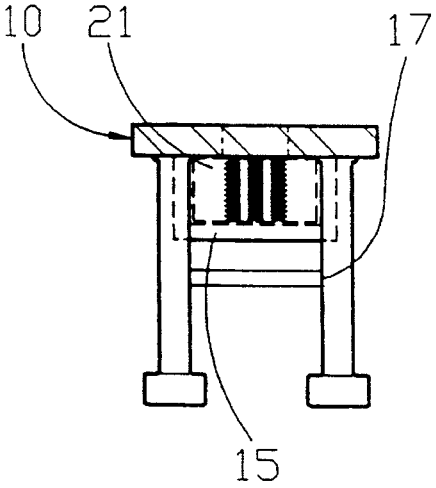
FIG. 7 is an end view of the insert with a nut attachment means.

FIG. 7 illustrates an end view of the insert 10 with a nut 21 inserted through opening 15 and then resealed with the plate 17 as to not allow concrete to pass within the channel 13 during the casting of concrete.

Figure 8:
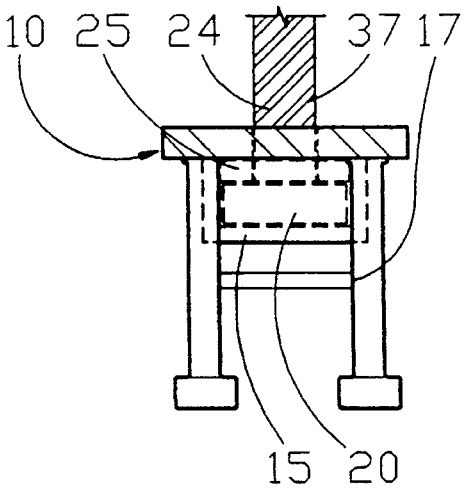
FIG. 8 is an end view of the insert with a steel strap and a plate washer adapted to the steel strap as the attachment means.

FIG. 8 illustrates the insert with a weldable strap 37 having a head 20 and a leg 24. The strap is inserted into the insert by first inserting a plate washer 25 so as to have the appropriate size hole 38 to allow the leg 24 of the strap 37 to pass through and then inserting the strap 37 through the opening 15 and through the plate washer opening 38 and then sealing with plate 17 as to not allow concrete to enter into the channel 13.

Figure 9:
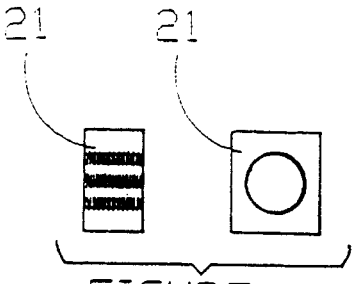
FIG. 9 is a plan and an elevation view of a square nut to be used with the insert.
Figure 13:
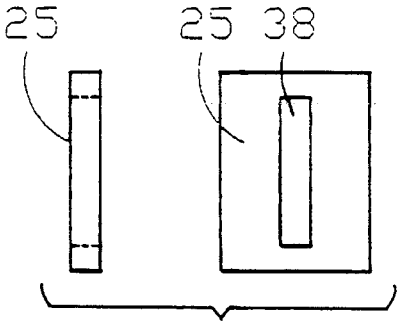
FIG. 13 is a plan and an elevation view of a plate washer adapted to the steel strap of FIG. 11.
Figure 11:
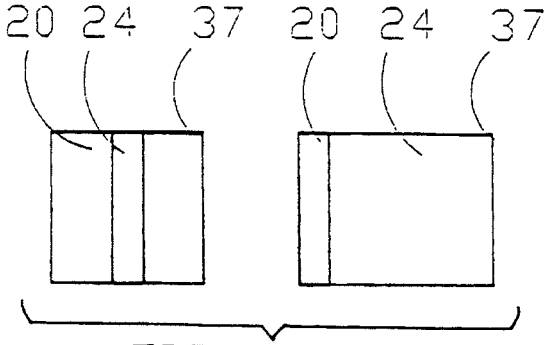
FIG. 11 is a plan and an elevation view of a steel strap to be used in the insert.

FIGS. 9 through 14 all illustrate top and end views of attachment devices. They are as follows: FIG. 9 is a typical nut 21, FIG. 10 is a typical bolt 22, FIG. 11 is a weldable strap 37, FIG. 12 is a special plate washer 52 to accommodate the bolt 22, FIG. 13 is a special plate washer 25 for the strap 37, FIG. 14 is a typical plate washer 23 for the bolt 22 to allow the bolt 22 to turn.

Figure 15:
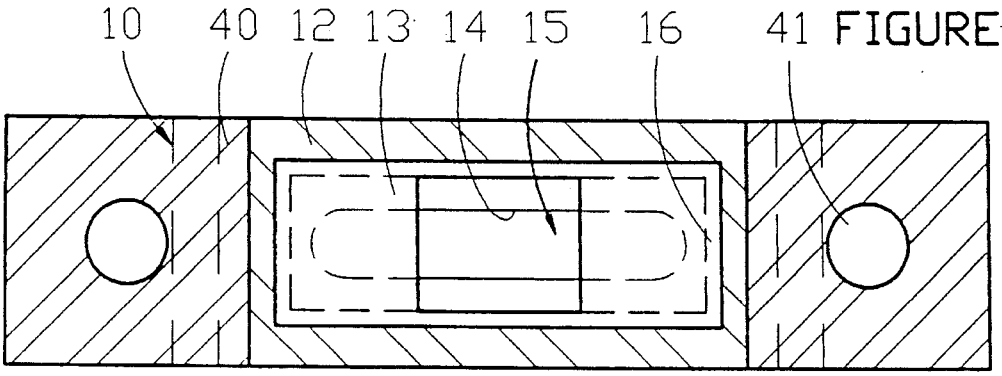
FIG. 15 is a plan view of the insert using angle members for the anchoring means.

FIG. 15 is an illustration of the plan view of the insert 10 with angle pieces 40 added for attachment to the concrete with an oversized hole 41 to accommodate an expansion anchor and a plate washer for mounting onto the concrete. The insert is the same as the insert of FIGS. 1 and 2 with the exception of mounting angles 40.

Figure 16:
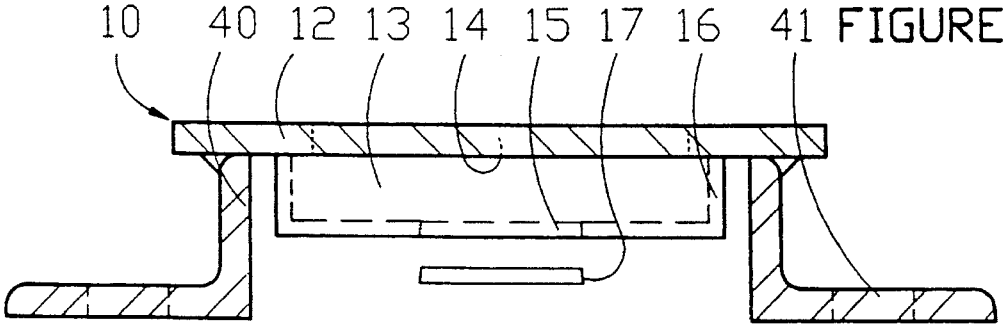
FIG. 16 is an elevation view of the insert from FIG. 15.

FIG. 16 is a side view of the insert demonstrating the angle members 40 in an appropriate configuration.

Figure 17:
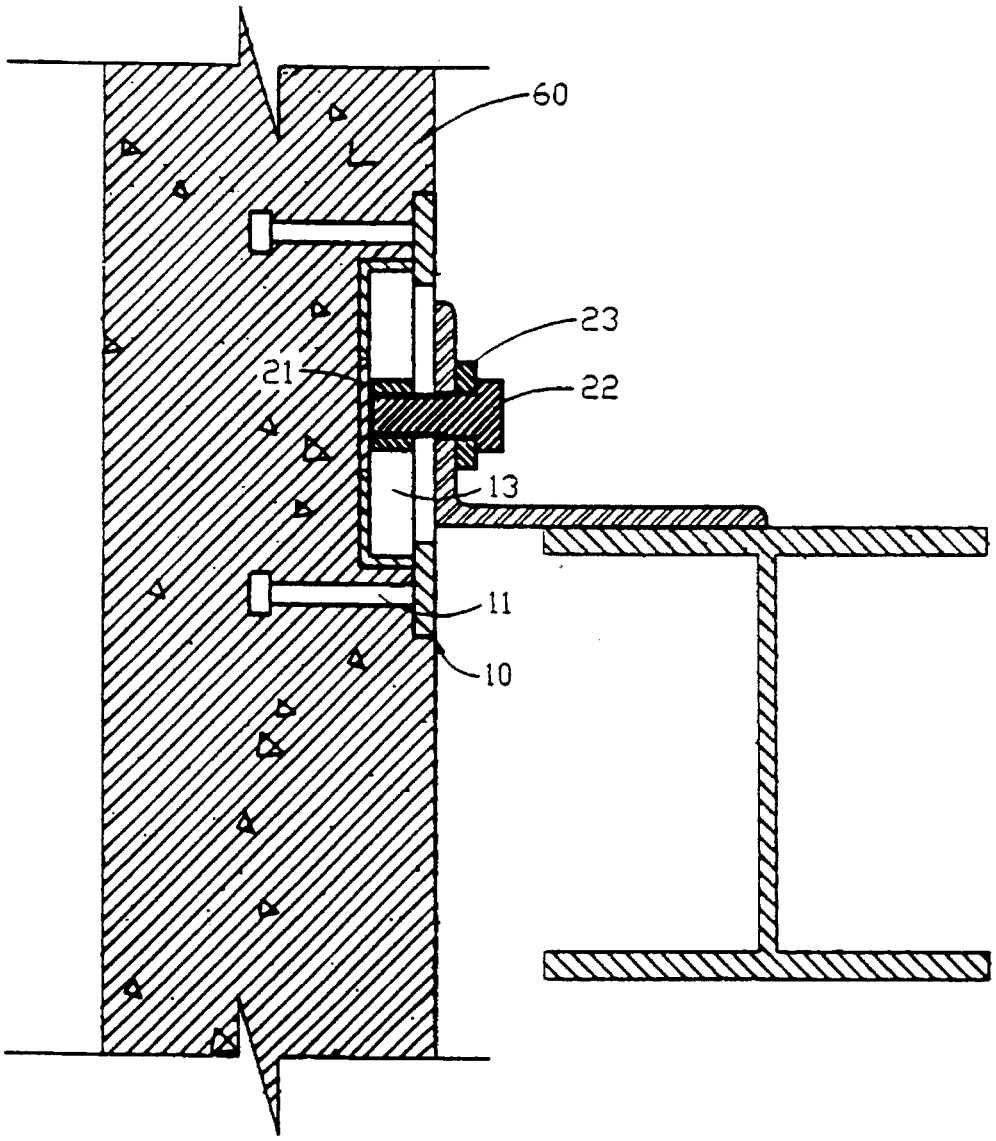
FIG. 17 is a sectional elevation view of the insert using a nut as the attachment means.

FIG. 17 is a sectional side view of a connection to an inner structure built of steel. The insert 10 is cast into concrete member 60. The concrete member 60 is then erected and an angle with a hole is attached with bolt 22 through plate washer 23 and into nut 21 to fasten the concrete member to the I-beam of the inner structure. The channel 13 allows movement horizontally and the weld formed between the angle and I-beam is created after all other adjustments have been made for horizontal and in-and-out movement.

Figure 18:
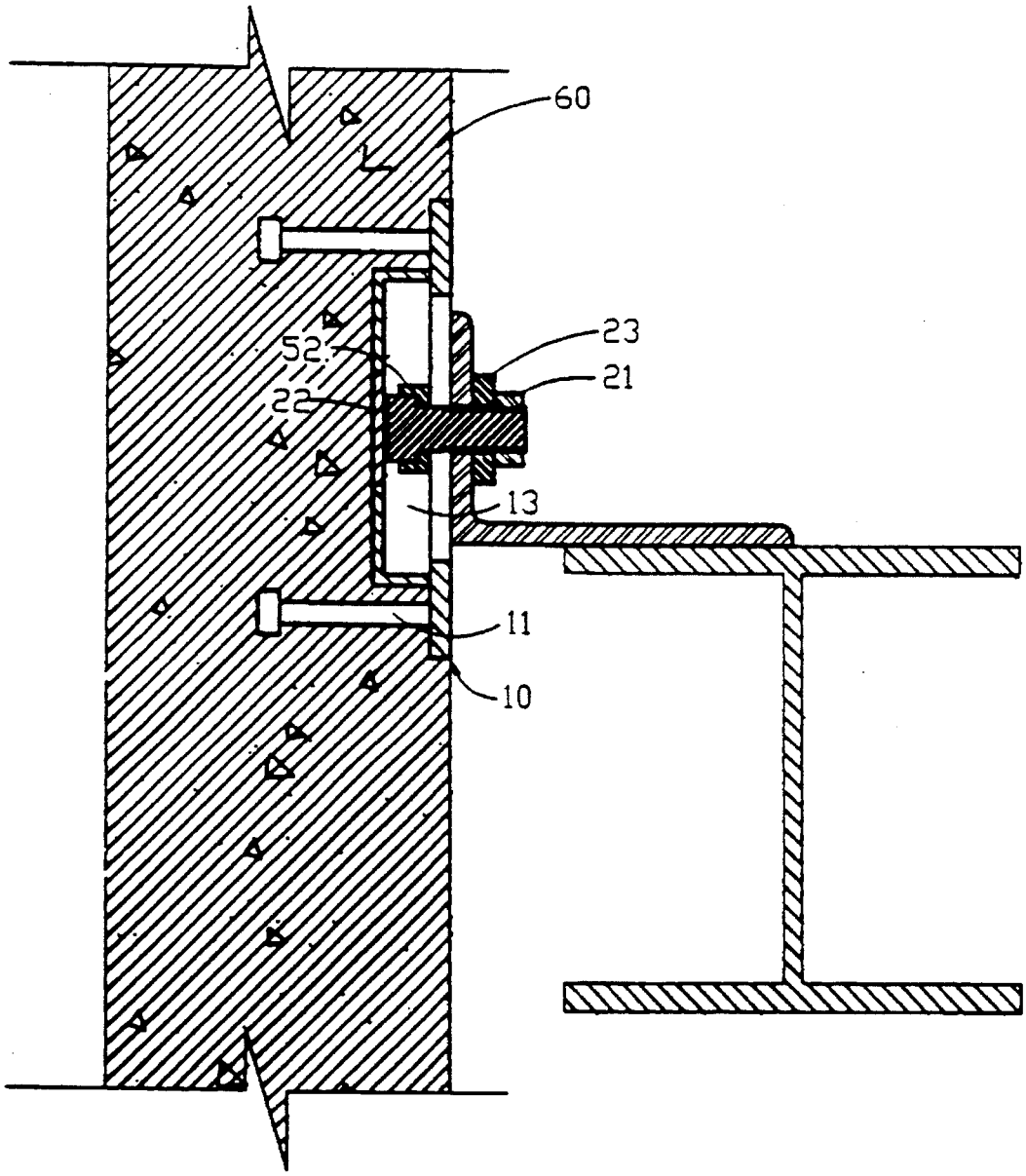
FIG. 18 is a sectional elevation view of the insert using a bolt and a plate washer as the attachment means.

FIG. 18 illustrates a concrete member 60 with insert 10 cast into it with a bolt 22 for an attaching device. The bolt 22 used in this instance can be an A-326 bolt and an A-325 nut 21 for a greater strength than indicated with FIG. 17. The A-325 bolt and nut has a different thread pattern and is not offered as a stock item in a heavy square nut form so to allow this connection to take place. The bolt must be inserted into the insert and the nut mounted outside the enclosure on to an inner structure.

Figure 19:
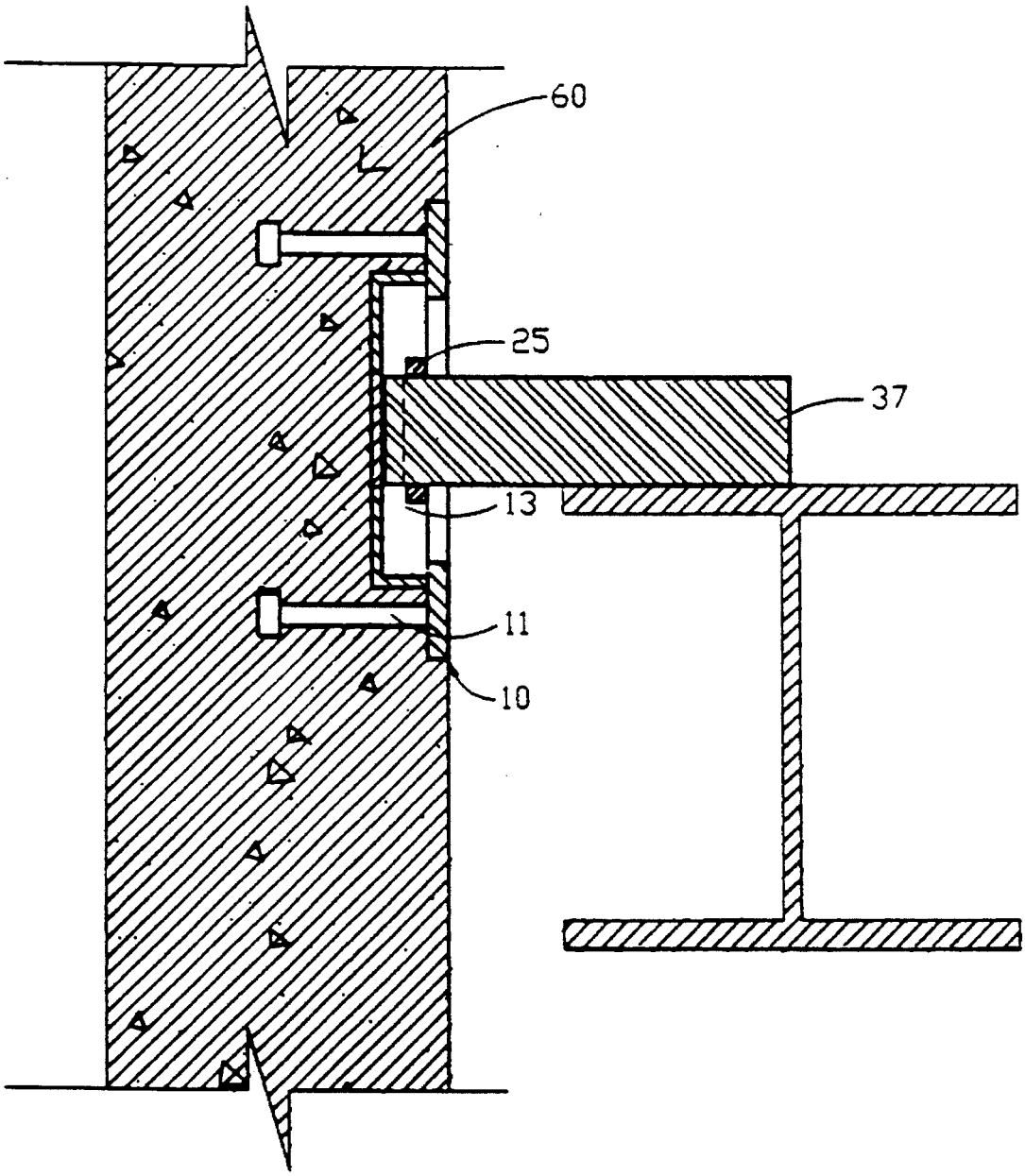
FIG. 19 is a sectional elevation view of the insert using a steel strap and plate washer as the attachment means.

FIG. 19 illustrates a use of a strap 37 as an attachment means. The strap 37 is fabricated with a head 20 that takes up a large area within the enclosure of the channel 13 cavity for greater strength. It is much stronger because its flat side is parallel with the insert 10 and this allows it to be wider at the point it enters the slot 14.

Figure 20:
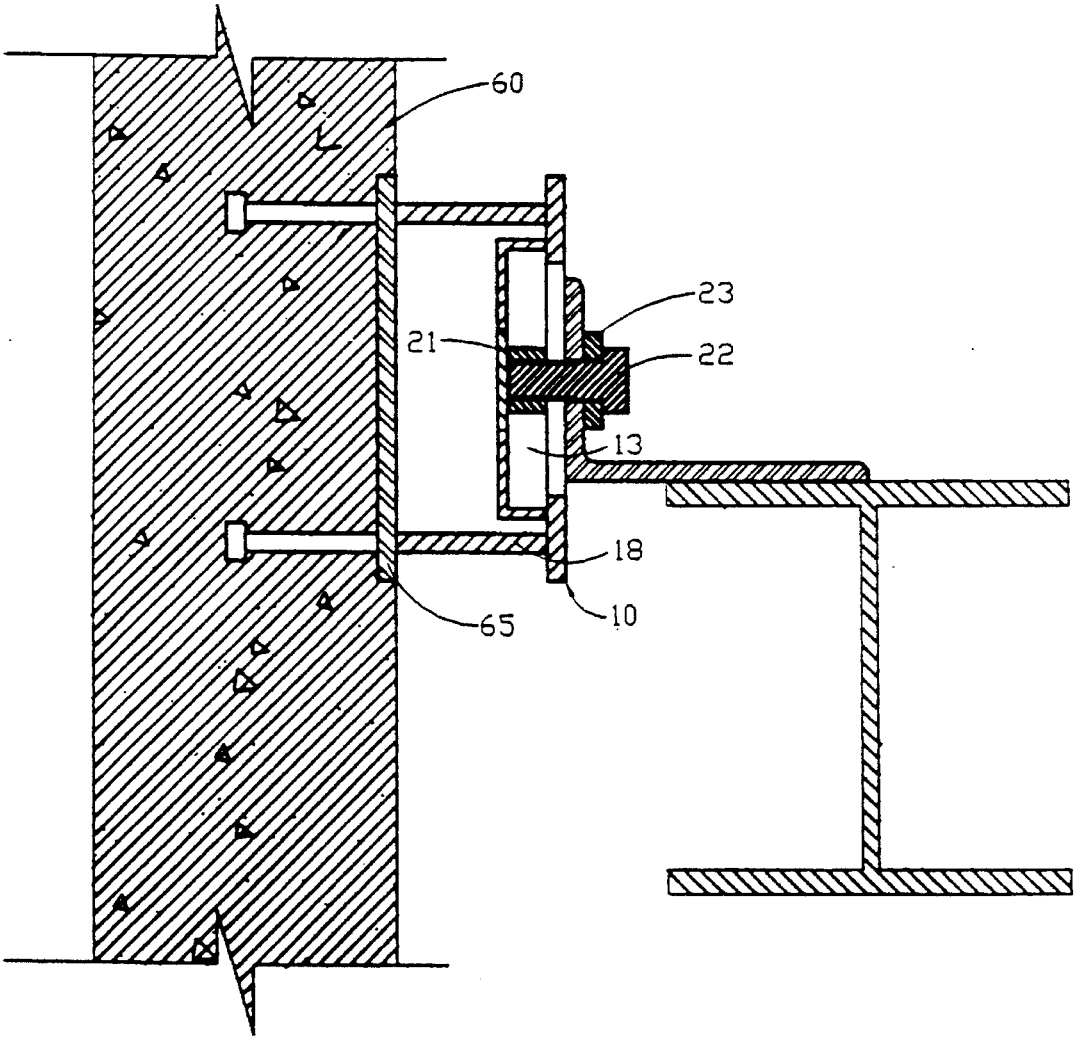
FIG. 20 is a sectional elevation view of the insert employed to repair a concrete member using a weld plate cast into the concrete for welding to the insert.

FIG. 20 illustrates a sectional top view of one possible application of the insert 10 attached to a weld plate 65 that has been placed in the proper location in a building structure. The insert 10 is then installed by welding plates 18 to the plate 65 in the concrete member 60. This is used to fix the concrete member 60 if, for instance, the concrete member were cast and no inserts were available to install.

Figure 21:
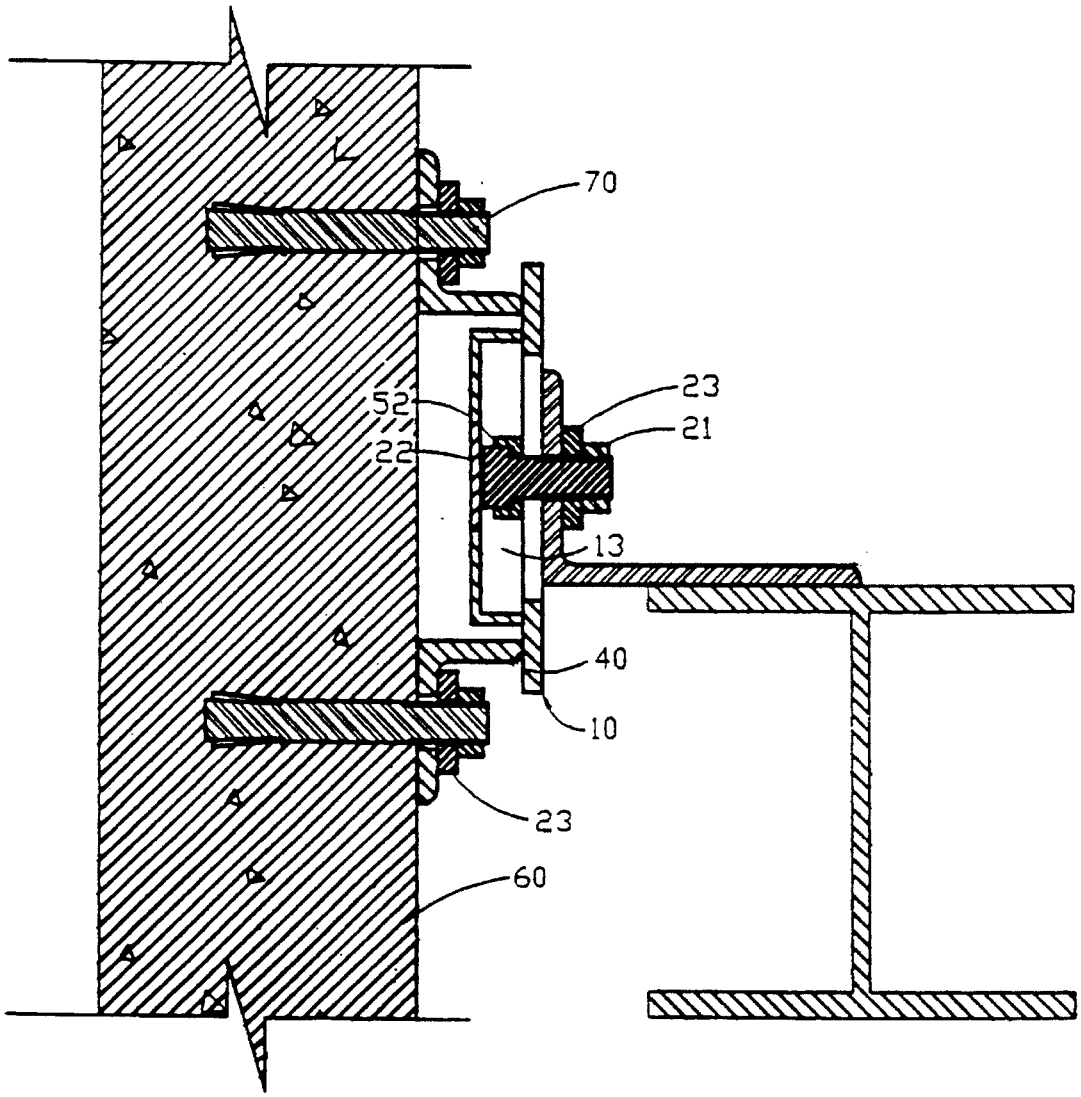
FIG. 21 is a sectional elevation view of the insert employed to repair a concrete member using the angle connections and expansion anchors to connect the insert to concrete.

FIG. 21 is an illustration of a sectional top view of a repair of a concrete member 60 where the insert 10 had been installed in an improper location or was not cast into the concrete. The expansion anchors 70 are installed through the hole 41 in the angle pieces 40 and attached to the insert 10 onto the concrete member 60 and attached to the inner structure. The connection is repaired and the expansion and contraction of the concrete is still accomodated.

The present invention is described with respect to certain preferred and alternative embodiments. A person of ordinary skill in the art would understand that certain variations in the present invention would be possible without departing from the spirit of the invention. The full scope of the present invention is set forth in the appended claims.

What is claimed is:

1. An adjustable insert for use with concrete or steel, comprising:

(a) an elongated plate having inner and outer surfaces and having a slot of uniform width extending along a longitudinal axis of said plate, said elongated plate being further characterized by a plate length and a plate width;

(b) an elongated body having first and second closed ends, a pair of closed longitudinal sides defining a space of uniform width wider than said uniform width of said slot, and an inner side substantially perpendicular to said closed ends and to said closed longitudinal sides and substantially parallel to and spaced apart from said elongated plate, said elongated body being attached to said inner surface of said elongated plate, said elongated body further having an exterior body length shorter than said plate length and an exterior body width narrower than said plate width;

(c) said inner side of said elongated body having an opening therein wider than said uniform width of said slot;

(d) anchoring means attached directly to said elongated plate for anchoring in concrete; and (e) structural attachment means received in said opening of said inner side of said elongated body and slidable between said longitudinal sides and between said elongated plate and said inner side of said elongated body, said structural attachment means further being sized so as to prevent passage of said structural attachment means through said slot.

2. The adjustable insert of claim 1 wherein said anchoring means comprises a headed concrete anchor.

3. The adjustable insert of claim 1 wherein said anchoring means comprises angle members having holes for insertion of expansion anchors.

4. The adjustable inserts of claim 1 wherein said anchoring means comprises steel plates.

5. The adjustable insert of claim 1 wherein said structural attachment means comprises a threaded bolt and a plate washer adapted to receive said threaded bolt.

6. The adjustable insert of claim 5 wherein said plate washer further comprises means to prevent said threaded bolt from turning.

7. The adjustable insert of claim 1 wherein said structural attachment means comprises a threaded nut.

8. The adjustable insert of claim 1 wherein said structural attachment means comprises a steel strap and a plate washer adapted to receive said steel strap.

* * * * *